United States Patent [19]

Magiera

[11] 4,039,192

[45] Aug. 2, 1977

[54] COMBINED CARD AND BOARD GAME APPARATUS

[75] Inventor: David L. Magiera, Bloomington, Minn.

[73] Assignee: Wicks & Nemer, P.A., Minneapolis, Minn.

[21] Appl. No.: 581,947

[22] Filed: May 29, 1975

[51] Int. Cl.[2] ..... A63F 3/00

[52] U.S. Cl. ..... 273/134 AT; 273/134 C; 273/134 D

[58] Field of Search ..... 273/134

[56] References Cited

U.S. PATENT DOCUMENTS

| | | | |
|---|---|---|---|
| 2,174,058 | 9/1939 | McGennis | 273/134 AT |
| 3,318,601 | 5/1967 | MacLeod | 273/134 AC |

FOREIGN PATENT DOCUMENTS

| | | | |
|---|---|---|---|
| 1,134,147 | 11/1968 | United Kingdom | 273/134 AT |
| 1,212,217 | 11/1970 | United Kingdom | 273/134 AT |

*Primary Examiner*—Delbert B. Lowe
*Attorney, Agent, or Firm*—Wicks & Nemer

[57] ABSTRACT

Combined card and board game apparatus is disclosed in the preferred embodiment for simulating the various stages of the legal process of a criminal case. The game apparatus includes a board having marked spaces or areas constituting a path of progression about the board. The players advance game markers about the path of progression collecting a first set of cards and a second set of cards during a preliminary hearing portion of the play of the present invention and in preparation for the trial portion of the play of the present invention. After a player has fulfilled certain requirements, the preliminary hearing portion of play of the present invention ceases and movement of the game markers on the path of progression stops. At this time, the players play the first and second set of cards obtained during the preliminary hearing portion of play to determine the outcome of the game play.

8 Claims, 5 Drawing Figures

COMBINED CARD AND BOARD GAME APPARATUS

BACKGROUND

The present invention relates generally to a board game and a card game, and more particularly to a combined card and board game including chance.

With the increasing amounts of leisure time available to persons generally in modern society, an increasing need has been felt for amusement devices to occupy such leisure time. A selected class of such amusement devices has been generally favored as providing substantially nonrepetitive play, requiring logic and intelligent decision making during play, and generally maintaining a high degree of interest for an extended period of time. A game according to the present invention includes attributes within this selective class.

The present invention provides such a game generally simulating the stages of the legal process of a criminal case.

SUMMARY

A preferred embodiment of the present invention includes a game board with marked spaces and areas constituting a path of progression about the board. Also provided are a first set of cards, a second set of cards, and a third set of cards. Game markers are further provided with one piece initially representing or being associated with each player. Chance taking apparatus are further provided for determining the movement of each player's game marker on the progression of spaces on the board.

It is thus a primary object of the present invention to provide a novel combined card and board game apparatus.

It is a further object of the present invention to provide such apparatus including chance.

It is a further object of the present invention to provide such apparatus for allowing the play of a card and board game generally simulating the stages of the legal process of a criminal case.

These and further objects and advantages of the present invention will become clearer in light of the following detailed description of an illustrative embodiment of this invention described in connection with the drawings.

DESCRIPTION

Figure 1:
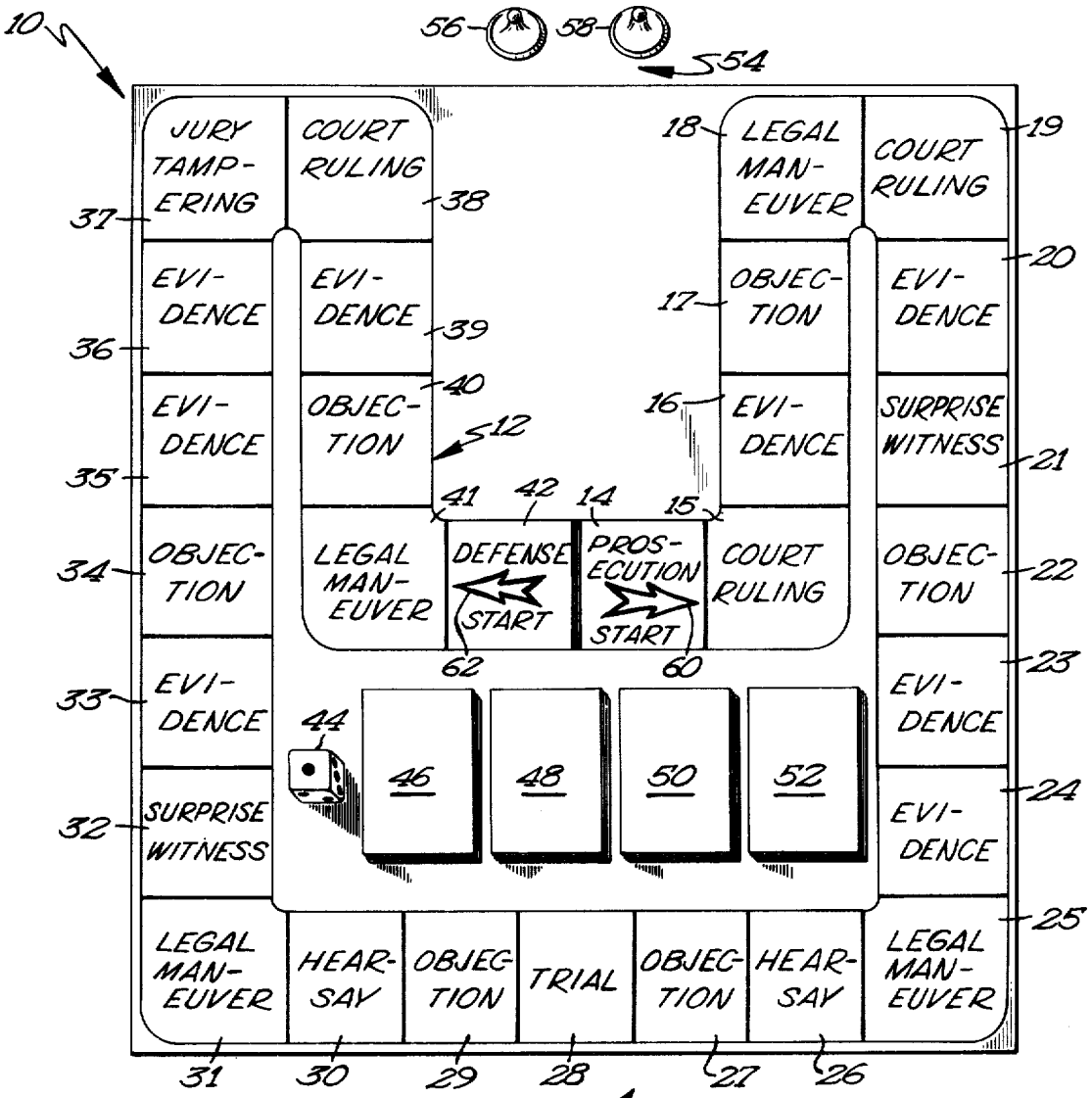
FIG. 1 shows a top plan view of a game board according to the teachings of the present invention, including plan and perspective views of various of the remaining apparatus for play of the game apparatus.

In FIG. 1, a game board 10 used in the combined card and board game apparatus of the present invention is shown. Game board 10 includes a plurality of marked spaces, locations, or areas constituting a path of progression about board 10, which path is generally designated 12. In particular, path 12 includes locations 14–42 arranged sequentially and continuously on game board 10. Further shown as situated on board 10 is first chance taking apparatus or dice 44. Also located on board 10 are stacks of cards in the form of cards 46 designated "PROSECUTION CASE CARD," cards 48 designated "DEFENSE CASE CARD," cards 50 designated "TRIAL CARD," and cards 52 designated "LEGAL MANEUVER." Cards 46, 48, 50 and 52 are arranged face down in the position indicated, and each set includes individually printed cards.

Figure 2:
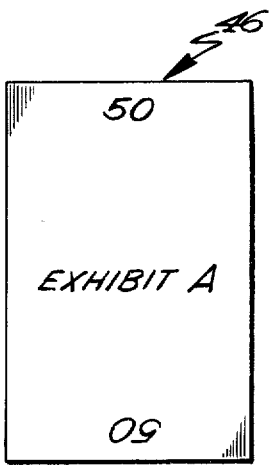
FIGS. 2, 3, 4, and 5 represent cards for use during play of the apparatus of FIG. 1.

In the preferred embodiment, the legends on the prosecution case cards 46 include the suits or subclasses, such as EXHIBIT, ARGUMENT, TESTIMONY, and STRATEGY and numerical values or game points, such as 50, 40, 30, 20, 10, and 5 for each subclass, an example of cards 46 being shown in FIG. 2.

Figure 3:
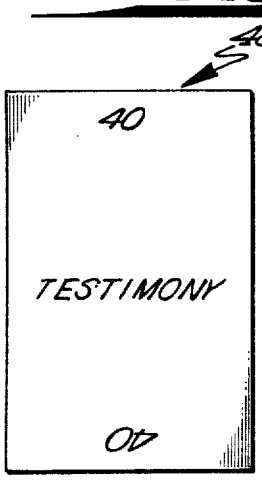

In the preferred embodiment, the legends on the defense case cards 48 also include the suits or subclasses, such as EXHIBIT, ARGUMENT, TESTIMONY, and STRATEGY, and numerical values or game points, such as 50, 40, 30, 20, 10, and 5 for each subclass, an example of cards 48 being shown in FIG. 3.

In the preferred embodiment, the legends on the trial cards 50 include an accused identification, such as AL "BLACKIE" MAILER, GUY GRABBER, BRUTUS KNOCKOWITZ, MACK D. KNIFE, EVELYN SALTOWAY, MELVIN KIPE, CONRAD MANN, and JIMMY LOCKE, a charge identification such as EXTORTION, KIDNAPPING, ASSAULT, MURDER, EMBEZZLEMENT, TAX EVASION, FRAUD, and ROBBERY, and a trump identification such as TESTIMONY, STRATEGY, ARGUMENT, and EXHIBIT, an example of cards 50 being shown in FIG. 4.

In the preferred embodiment, the legends on the faces of the legal maneuver cards 52 are:

DELAY OF TRIAL

THE HONORABLE GAVIL RAPPHAMMER RULES AGAINST ANY LEGAL MANEUVER CARD PLAYED ON YOU

OBJECTION SUSTAINED

COURT RULES IN YOUR FAVOR PREVENTS CANCELLING CASE CARD

INADMISSIBLE TESTIMONY CANCELS TESTIMONY CASE CARD

OBJECTION OVERRULED VOIDS ANY OBJECTION

INADMISSIBLE EXHIBIT CANCEL EXHIBIT CASE CARD

ADVANCE TO TRIAL

COURT RULES IN YOUR FAVOR PREVENTS LOSING CASE CARD

COUNSEL BADGERING THE WITNESS CANCEL STRATEGY CASE CARD

IRRELEVANT, INCOMPETENT, AND IMMATERIAL CANCEL ARGUMENT CASE CARD

Figure 5:
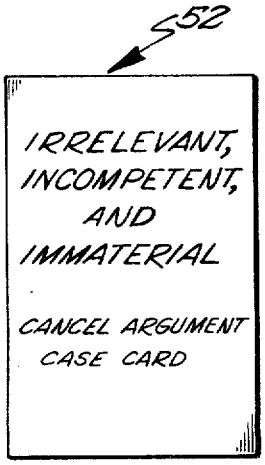

A sample of the face of a legal maneuver card 52 is also shown in FIG. 5. Legal maneuver cards 52 detrimentally counteract with the play of cards 46 and 48 during the trial portion of play, as will be explained further hereinafter.

Also shown in FIG. 1 are a plurality of individual playing pieces, generally designated 54, shown as situated adjacent to board 10. Pieces 54 include separate player pieces 56 and 58, which may be items specifically related to rules of the game, or other pieces which can be separately identified.

Locations 14–42 of path 12 on board 10 have various instructions thereon instructing the particular player who lands thereon to follow certain game instructions. Generally, path 12 includes reward/penalty locations, locations associated with case cards 46 or 48, and locations associated with legal maneuver cards 52.

In particular, location 14 is the start location for the particular player representing the prosecution to begin movement about path 12 in a clockwise manner. Further included on location 14 is a member 60 indicating the movement direction of the player representing the prosecution, shown in the preferred form as an arrow. Location 42 is the start location for the particular player representing the defense to begin movement about path 12 in a couterclockwise manner. Further included on location 42 is a member 62 indicating the movement direction of the player representing the defense, shown in the preferred form as an arrow. It can then be appreciated that path 12 acts as a dual directional path in that the players advance about path 12 in opposite directions.

Locations 15, 19, and 38 have instruction degends thereon instructing the player who lands thereon to recapture one legal maneuver card 52 from the opposing player, as will be explained hereinafter.

Locations 16, 20, 23, 24, 33, 35, 36, and 39 have instruction legends thereon instructing the player who lands thereon to draw a case card 46 or 48, depending upon whether the player thereon represents the prosecution or the defense, from the stack of cards 46 or 48.

Locations 17, 22, 27, 29, 34, and 40 have instruction legends thereon allowing the player who lands thereon to "OBJECT," as will be explained further hereinafter.

Locations 18, 25, 31, and 41 have instruction legends thereon instructing the player who lands thereon to draw a legal maneuver card 52 from the stack of cards 52.

Locations 21 and 32 have instruction legends thereon instructing the player who lands thereon either to draw a case 46 or 48, depending upon whether the player represents the prosecution or defense, from the stack of case cards 46 or 48, or to draw a legal maneuver card 52 from the stack of legal maneuver cards 52.

Location 37 has instruction legends thereon instructing the player who lands thereon to forfeit one legal maneuver card 52 to the bottom of the stack of cards 52.

Location 28 has instruction legends thereon instructing the player who lands thereon or passes thereby to begin trial if the player meets certain game objectives, as will be explained hereinafter.

The objective of the game apparatus of the present invention is to allow the play of a combined card and board game wherein, during the first portion of play, game markers representing individual players progress about a path on the board in a repetitive and cyclic manner depending upon a chance taking apparatus, in this case dice 44, and in the second portion of play, players lay down playing cards to determine the winning player. Specifically, the board game apparatus of the present invention is the combination of a board-type game and a card game, and in the preferred embodiment, simulates the various stages of a criminal case through the legal system. Progression about the board allows various transactions to occur simulating a preliminary hearing of the criminal case in which the player collects case cards 46 or 48, depending upon whether the particular player represents the prosecution of the defense, and legal maneuver cards 52. After one of the players lands on or passes by location 28, movement of game pieces 54 on path 12 stops and the play of the game continues by the playing of cards 46, 48, and 52, as will be explained further hereinafter, representing the trial stage of a criminal case.

Each player is assigned a playing piece 54 such as playing pieces 56 and 58 shown in FIG. 1. Players then determine which player will represent the prosecution and which player will represent the defense. In the preferred embodiment, each player rolls dice 44 and the player obtaining the highest number on the dice chooses whether he wishes to represent the prosecution or the defense and also chooses which trial card 50 will be used during play. The players then place their particular playing piece 56 or 58 on locations 14 and 42, depending upon whether the particular player is representing the prosecution or the defense. The first player, assumed for the purpose of this description to have been assigned playing piece 56 and representing the prosecution, then begins play by rolling dice 44 and moving his playing piece in a clockwise manner from location 14 the number of squares indicated by the vertically facing dots, as conventional. After the player moves his piece to the correct location and follows the instructions thereon, dice 44 is given to the second player who continues play by rolling dice 44 and moving his playing piece 58 from location 42 in a counterclockwise manner the number of squares indicated by the vertically facing dots on the dice, as conventional.

During the preliminary hearing portion of the play, the players advance about path 12 acquiring case cards 46 or 48 and legal maneuver cards 52. However, a player can only acquire a maximum of eight case cards 46 and 48 and a maximum of four legal maneuver cards 52. If a player has collected his maximum amount of case cards 46 or 48 and legal maneuver cards 52, and the player lands on a location instructing the player to draw another case card 46 or 48 or legal maneuver card 52, the player may pass, or the player may discard a case card 46 or 48 or a legal maneuver card 52 of his choice to the bottom of the stack and then draw a new case card 46 or 48 or legal maneuver card 52.

Because opposing players travel in opposite directions, they pass and meet each other on path 12 many times during the preliminary hearing portion of play. The player who is passed by his opponent must forfeit one case card 46 or 48 of his choice to that opponent. This case card is considered a captured case card 46 or 48 and remains face up beside the opponent's hand until the case card is either recaptured or canceled.

Each player is allowed three "VERBAL OBJECTIONS," together with the opportunity to "OBJECT" when the player lands on locations 17, 22, 27, 29, 34, and 40 as previously explained. The player raises the objection immediately if he lands on locations 17, 22, 27, 29, 34, and 40 but may use his three "VERBAL OBJECTIONS" at any point during play of the entire game including the preliminary hearing portion of play and the trial portion of play. Every objection, whether it be verbal or from landing on locations 17, 22, 27, 29, 34, and 40 must be immediately ruled upon, in the preferred embodiment, by a roll of dice 44. If the vertically facing dots on dice 44 represent an even number, the court sustains the objection, and if they represent an odd number, the court overrules the objection. If an objection is sustained, the objecting player may exercise one of ten different options:

1. The objecting player may capture a case card 46 or 48 from an opponent's hand;
2. The objecting player may cancel a captured case card 46 or 48 by returning the captured case card 46 or 48 to the bottom of the appropriate deck;

3. The objecting player may capture a legal maneuver card 52 from the opponent's hand;
4. The objecting player may cancel a legal maneuver card 52 by drawing a legal maneuver card 52 from the opponent's hand and returning it to the bottom of the stack of legal maneuver cards 52;
5. The objecting player may recapture a case card 46 or 48 of his choice from those his opponent has captured;
6. The objecting player can retain a legal maneuver card 52 and thus avoid losing it to his opponent;
7. The objecting player may first discard and then draw a new case card 46 or 48;
8. The objecting player, if his playing piece 54 lands on location 26 and 30, may disregard instructions of location 26 and 30;
9. The objecting player can retain a case card 46 or 48 and thus avoid losing a case card 46 or 48 to his opponent;
10. The objecting player can delay trial and stop his opponent from bringing the case to trial if the opponent lands on or passes by location 28 or is instructed to bring the case to trial by a legal maneuver card 52.

Figure 4:
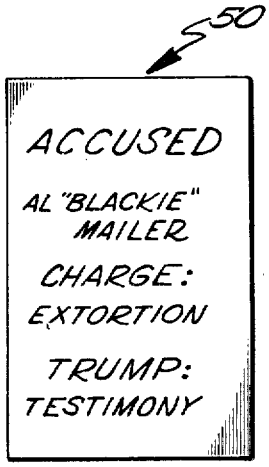

A player may stop the preliminary hearing and bring the case to trial upon the fulfillment of two conditions. The player must have collected eight case cards 46 and 48 and either landed upon or passed location 28 with his present turn, or received a legal maneuver card 52 instructing the player to advance the case to trial. Once the case is brought to trial, all captured cards 46, 48, or 52 held by the respective players are returned to the bottom of the respective decks. Once the case has been brought to the trial portion of play of the game, the player representing the prosecution initiates card play. The prosecution lays a case card 46. The player representing the defense then plays a card of the same suit or subclass and the player having the largest numerical value of the cards laid retains the trick. If the player representing the defense does not have a case card 48 of the same suit, he may sluff a card of a different suit, allowing the prosecution player to collect the trick or may "trump" the trick by laying a card 48 of the suit identified in the trump identification of card 50 such as the subclass "TESTIMONY" as shown in FIG. 4. The player who has taken the trick then repeats this process until all the case cards are played.

It should then be noted that, during the trial portion of the game, the legal maneuver cards 52 acquired during the preliminary hearing portion of the game can be used by the players. A legal maneuver card 52 can be played immediately following the play of an opponent's card and the instructions printed thereon are followed. All legal maneuver cards 52, except pronouncing a "COURT RULES" or a "COURT RULING", may be objected to and any cards canceled by legal maneuvers or verbal objections are ignored and excluded from the outcome of the trial.

Further, it should be noted that each player is allowed three verbal objections during the course of the game. He may spend all or any of them during the preliminary hearing portion of play and/or during the trial portion of play. A verbal objection can be called immediately following the play of an opponent's case card or legal maneuver card in the trial portion of the game play. If an objection is raised against the opponent laying a particular case card, it is determined whether the objection will be sustained or overruled as previously explained. If the objection is sustained, the opponent picks up the case card 46 or 48 laid and plays a different card. If the objection is overruled, the case card 46 or 48 remains in play and play continues as if the objection had not been raised.

If an objection is voiced against an opponent's legal maneuver card 52 and the objection is sustained, the legal maneuver card 52 is canceled and excluded for the duration of the trial. If the objection is overruled, the instructions of the legal maneuver card are followed and play continued as if the objection had not been raised.

For example, if player number 1 leads with an exhibit/30 case card and player number 2 follows with an exhibit/40 case card, player number 2 wins the trick. But, suppose player number 1 plays upon his opponent's exhibit 40 card the legal maneuver card "INADMISSIBLE EVIDENCE", which cancels the exhibit card. In this case, player number 2 is faced with two choices: he may either play his own legal maneuver card to counteract the legal maneuver card played upon him, or spend one of his verbal objections, if he has one remaining, to invalidate the legal maneuver card 52 played upon him. If player number 2 succeeds, then player number 1 may choose to play another legal maneuver card, if he has one and it applies. He cannot use a verbal objection if his opponent's objection has been sustained. Play continues in this manner until a player has won a trick.

To determine the winning player, the numerical values of all the case cards 46 and 48 which the player won in tricks during the trial portion of play and also cards 46 and 48, if any, remaining in the player's hand, if the player has cards 46 or 48 remaining in his hand and the opposing player does not at the end of the trail portion of play, such as in the case where during the preliminary hearing, one player did not have eight case cards 46 or 48 in his hand at the time of trial. The player having the highest number is the winning player.

It can then be appreciated that during the preliminary hearing portion of play of the preferred embodiment of the present invention, the players advance their playing pieces 54 in opposite directions on dual directional path 12. When the player advances on path 12 and lands on particular locations, the player obtains or loses particular case cards 46 or 48 and legal maneuver cards 52 associated with the particular location. When a player has collected eight case cards 46 or 48 and either lands on or passes location 28 or obtains legal maneuver card 52 instructing the player to advance to trial, the preliminary hearing portion of play ceases and movement of pieces 54 on path 12 stops. It can then be realized that the preliminary hearing portion of play distributes the case cards 46 or 48 to the particular players and therefore is analogous to dealing cards in a card type game. However, the present invention allows the nonrepetitive play and logic and intelligent decision making together with chance of a board game to be utilized in the distribution of cards 46, 48 and 52.

During the trial portion of play, cards 46, 48, and 52 are played in a manner analogous to card games to further allow logic and intelligent decision making together with chance in determining the winning player of the game play.

Now that the basic teachings of the present invention have been explained, many extensions and variations will be obvious to one having ordinary skill in the art. For example, to change the length of time required to play the game, the winning requirements can be changed such as requiring the winning player to have won two trials.

Additionally, it should be realized that the prosecution case cards 46 and the defense case cards 48 can be mixed together.

Thus since the invention disclosed herein may be embodied in other specific forms without departing from the spirit or the general characteristics thereof, some of which forms have been indicated, the embodiments described herein are to be considered in all respects to be illustrative and not restrictive. The scope of the invention is indicated by the appended claims rather than by the foregoing description and all changes which come within the meaning and range of equivalency of the claims are intended to be embraced therein.

What is claimed is:

1. Combined card and board game apparatus comprising, in combination: first means for indicating game points; second means for detrimentally counteracting the first means during play thereof; a game board having locations arranged thereon forming a path of progression, the locations including reward/penalty locations, locations associated with the first means, and locations associated with the second means; game markers for movement around the locations on the board; and chance taking apparatus for determining movement of the game markers around the locations on the board during the first portion of play allowing collection of the first means and of the second means by the players as the game markers land on the locations for use during the second portion of play allowing the use of the first means and the second means to determine the winning player.

2. The apparatus of claim 1 wherein the first means further includes third means for differentiating the first means into subclasses.

3. The apparatus of claim 2 wherein the apparatus further includes fourth means for indicating a particular subclass of the first means as differentiated by the third means.

4. The apparatus of claim 1 wherein the locations further include a first start location including fifth means for indicating the movement direction of the game marker associated therewith and a second start location including sixth means for indicating the movement direction of the game marker associated therewith.

5. The apparatus of claim 4 wherein the fifth means indicates a movement direction opposite to the movement direction indicated by the sixth means, and with the path of progression being a dual direction path allowing the game markers to progress in opposite directions along the path.

6. The apparatus of claim 3 wherein the first means, second means, and fourth means comprise cards.

7. The apparatus of claim 6 wherein the first means comprises: a first form of cards; and a second form of cards separately identifiable from the first form of cards.

8. The apparatus of claim 1 wherein the apparatus simulates the stages of the legal process of a criminal case wherein the first portion of play simulates the preliminary hearing portion and wherein the second portion of play simulates the trial portion of play

* * * * *